US008440910B2

(12) United States Patent
Nonen et al.

(10) Patent No.: US 8,440,910 B2
(45) Date of Patent: May 14, 2013

(54) DIFFERENTIAL SIGNAL TRANSMISSION CABLE

(75) Inventors: Hideki Nonen, Hitachi (JP); Takahiro Sugiyama, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 480 days.

(21) Appl. No.: 12/702,833

(22) Filed: Feb. 9, 2010

(65) Prior Publication Data

US 2011/0100682 A1 May 5, 2011

(30) Foreign Application Priority Data

Oct. 30, 2009 (JP) ..... 2009-250972

(51) Int. Cl.
*H01B 7/00* (2006.01)
*H01B 11/02* (2006.01)

(52) U.S. Cl.
USPC ..... 174/115; 174/117 R; 174/113 R

(58) Field of Classification Search ..... None
See application file for complete search history.

(56) References Cited

U.S. PATENT DOCUMENTS

| | | | | |
|---|---|---|---|---|
| 5,565,653 | A * | 10/1996 | Rofidal et al. | 174/113 R |
| 5,956,445 | A * | 9/1999 | Deitz et al. | 385/100 |
| 7,999,185 | B2 * | 8/2011 | Cases et al. | 174/113 R |
| 2004/0026101 | A1 | 2/2004 | Ochi | |

FOREIGN PATENT DOCUMENTS

| | | | |
|---|---|---|---|
| JP | 2002-289047 | A | 10/2002 |
| JP | 2003-297154 | A | 10/2003 |
| JP | 2004-79439 | A | 3/2004 |

* cited by examiner

*Primary Examiner* — Jayprakash N Gandhi
*Assistant Examiner* — Dion Ferguson
(74) *Attorney, Agent, or Firm* — Foley & Lardner LLP

(57) ABSTRACT

A differential signal transmission cable has two conductor wires disposed to be parallel with each other, a flat insulating member collectively covering the two conductor wires, the insulating member having flat portions facing to each other in a direction perpendicular to an alignment direction of the two conductor wires to sandwich the two conductor wires, a shield conductor including a metal foil tape and being wound around an outer periphery of the insulating member, a drain wire provided to contact with the shield conductor at a position corresponding to the flat portion, and a jacket jacketing the drain wire and the shield conductor.

16 Claims, 9 Drawing Sheets

DIFFERENTIAL SIGNAL TRANSMISSION CABLE

The present application is based on Japanese Patent Application No. 2009-250972 filed on Oct. 30, 2009, the entire contents of which are incorporated herein by reference.

BACKGROUND OF THE INVENTION

1. Field of the Invention

The present invention relates to a differential signal transmission cable, more particularly, to a differential signal transmission cable for transmitting high speed digital signals corresponding to 10 Gbps over a distance of several meters to several tens of meters with less signal waveform distortion.

2. Related Art

In servers, routers and storage associated equipments for processing high speed digital signals of several Gbps or more, differential signal transmission is used for signal transmission between devices or between boards in the same device, and a differential signal transmission cable is used as transmission medium.

The "differential signal transmission" is a signal transmission of transmitting two kinds of signals, in which a phase of one signal is inverted by 180 degrees from a phase of another signal, through a pair of two conductor wires respectively, and taking out a difference between the two signals at a receiving end side.

Since electric current flown through one of the two conductor wires and electric current flown through another one of the two conductor wires are flown in directions opposite to each other, an electromagnetic wave emitted from the differential signal transmission cable which serves as a transmission line is small. Further, since extraneous noises equally superpose on the two conductor wires, the extraneous noises are canceled (offset) by taking out the difference at the receiving end side, so that adverse influences by the extraneous noise can be removed. For these reasons, the differential signal transmission has been often used for high speed signals.

As representative differential signal transmission cable, a twisted-pair cable has been known. In the twisted-pair cable, two insulated electric wires each of which has a conductor wire coated with an insulating member are twisted as one pair.

The twisted-pair cable is inexpensive and excellent in balancing characteristics. Further, the twisted-pair cable can be easily bent. Therefore, the twisted-pair cable has been used broadly. However, since the twisted-pair cable has no conductor corresponding to a ground, the twisted-pair cable is easily affected by a metal member located in vicinity of the twisted-pair cable, so that characteristic impedance of the twisted-pair cable is not stable. Further, in the twisted-pair cable, a signal waveform is easily distorted in a high frequency band of several GHz. Therefore, it is difficult to employ the twisted-pair cable for the high speed signal transmission of several Gbps.

As to a shielded twisted-pair cable in which a shield is provided at an outer side of the twisted-pair cable, such a shielded twisted-pair cable has been already proposed as LAN cable. A tolerance for the extraneous noise is improved by an effect of shield. However, as for the twisted-pair cable, since the two conductors are twisted as one pair, attenuation of the signal is large. In a system using the shielded twisted-pair cable, an electric power required in signal processing for compensating the attenuation of the signal is increased (six times to ten times of the electric power required in a case of using a twinax cable to be described later), so that a power consumption is large.

On the other hand, the twinax cable in which two insulated electric wires are disposed in parallel without being twisted, and coated with a shield conductor has been used broadly. The "twinax cable" is also called as "twin-axial cable" or "twin coaxial cable". In the twinax cable, the two insulated electric wires are disposed in parallel without being twisted, so that there is little difference in physical length between the two conductor wires, compared with the twisted-pair cable. In addition, since the shield conductor are disposed to cover the two insulated electric wires, even if the metal member is installed in vicinity of the twinax cable, the characteristic impedance of the twinax cable will not become unstable, and the noise resistant property is high.

The twinax cable has been used for the high speed signal transmission of several Gbps or more. There are various type of twinax cable, for example, a twinax cable using a tape with a conductor as a shield conductor, a twinax cable using a braided wire as a shield conductor, and a twinax cable using a drain wire together with a shield conductor.

FIG. 12 shows a cross-sectional view of a first example of conventional twinax cables. As shown in FIG. 12, in the first example of the conventional twinax cables, two signal transmission conductor wires 1201, 1204 are insulated by insulating members 1202, 1205, respectively to provide two insulated electric wires 1203, 1206, and a shield conductor 1207 comprising a metal foil tape in which aluminum or the like is adhered to a polyethylene tape is wound around the two insulated electric wires 1203, 1206. A drain wire 1208 is lengthwise provided between the shield conductor 1207 and the insulated electric wires 1203, 1206 to contact a conducting plane of the shield conductor 1207, so as to ground the shield conductor 1207. An outer surface of the shield conductor 1207 is jacketed with a jacket 1209 so as to protect a cable interior. The shield conductor 1207 is electrically connected to a printed circuit board (not shown) via the drain wire 1208 which is in contact with the shield conductor 1207.

FIG. 13 shows a cross-sectional view of a second example of conventional twinax cables, which is disclosed by Japanese Patent Laid-Open No. 2004-79439 (JP-A 2004-79439). As shown in FIG. 13, in the twinax cable of the second example, two conductor wires 1301, 1304 are insulated by insulating members 1302, 1305, respectively to provide two insulated electric wires 1303, 1306, and a shield conductor 1307 is wound around the two insulated electric wires 1303, 1306. A drain wire 1308 is lengthwise provided between the shield conductor 1307 and the insulated electric wires 1303, 1306 to contact a conducting plane of the shield conductor 1307, so as to ground the shield conductor 1307. The shield conductor 1307 is jacketed with a jacket (not shown), similarly to the twinax cable of FIG. 12. However, in the second example, the drain wire 1308 having a non-circular cross section is used so as to reduce displacement (location gap) of the drain wire 1308. This twinax cable is configured based on an expectation that a stress acting between the insulated electric wires 1303, 1306 and the drain wire 1308 may be dispersed, thereby suppressing collapse of the insulating members 1302, 1305.

FIG. 14 shows a cross-sectional view of a third example of conventional twinax cables, which is disclosed by Japanese Patent Laid-Open No. 2003-297154 (JP-A 2003-297154). As shown in FIG. 14, in the twinax cable of the third example, two conductor wires 1401, 1404 are insulated by an insulating member 1402, and a drain wire 1408 is lengthwise provided on the insulating member 1402. A shield conductor 1407 is wound around an outer periphery of the insulating member 1402 as well as the drain wire 1408. The shield conductor 1407 is jacketed with a jacket 1409. In the third example, so as to solve the problem of the location gap of the drain wire 1408, the insulating member 1402 is extrusion-molded to have a gourd-like cross section for reducing a digging of the drain wire 1408 into the insulating member 1402.

Further, in the twinax cable of FIG. 14, the conductor wires 1401, 1404 are commonly covered by the insulating member 1402. In the twinax cable of FIG. 12, although the insulating members 1202, 1205 covering the conductor wires 1201, 1204 are provided in the two insulated electric wires 1203, 1206, the two insulating members 1202, 1205 are not fabricated in the same timing during the manufacturing process (e.g. the two insulating members 1202, 1205 may be formed in different lots). Therefore, dielectric constants of the insulating members 1202, 1205 are not completely equal to each other. On the other hand, in the twinax cable of FIG. 14, all parts of the insulating member 1402 covering the two conductor wires 1401, 1405 are fabricated in the same timing, so that the dielectric constants of a part covering the conductor wire 1401 and a part covering the conductor wire 1405 are equal to each other.

FIG. 15 shows a cross-sectional view of a fourth example of conventional twinax cables, which is disclosed by Japanese Patent Laid-Open No. 2002-289047 (JP-A 2002-289047). As shown in FIG. 15, in the twinax cable of the fourth example, two conductor wires 1501, 1504 are insulated by insulating members 1502, 1505, respectively to provide two insulated electric wires 1503, 1506, and a shield conductor 1507 is wound around the two insulated electric wires 1503, 1506. A drain wire 1508 is lengthwise provided on an outer periphery of the shield conductor 1507 to contact a conducting plane of the shield conductor 1507. The shield conductor 1507 is jacketed with a jacket 1509. The drain wire 1508 is disposed on a side of the insulated electric wire 1503. The drain wire 1508 and the conductor wires 1501, 1504 are pulled out to be parallel with a constant distance at the time of connecting the twinax cable of FIG. 15 to the printed circuit board (as shown in FIG. 16), connection workability is good.

FIG. 16 is a perspective view showing a case of connecting the conventional twinax cable to a printed circuit board by soldering. As shown in FIG. 16, in as state that the twinax cable of FIG. 15 is connected by soldering to a printed circuit board 1606, the two conductor wires 1501, 1504 are connected to signal line pads 1604, 1605 in the printed circuit board 1606, respectively, and the drain wire 1508 is connected to a ground pad (GND pad) 1603. Packaging density of the twinax cable on the printed circuit board 1606 at this time depends upon a width P1 of the jacket 1509 of the twinax cable.

FIG. 17 is a perspective view showing a conventional transmission line using a printed circuit board. As shown in FIG. 17, in the conventional transmission line using the printed circuit board, a signal transmitted from a transceiver IC 1701*a* is transmitted through a wiring pattern 1709 and via a connector 1707 to a backplane board 1706. A signal transmitted from the backplane board 1706 is transmitted via connector 1704 and through the wiring pattern 1705 to a transceiver IC 1701*b* which is a receiving terminal. A line card 1703*a* and a line card 1703*b* are mated with the connectors 1707 and 1704 to be held by the backplane board 1706.

Common mode noise filters 1708 are in-line provided on the wiring patterns 1709 and 1705, respectively, in order to shut off a common mode component that is the noise. The common mode component arriving at a receiving terminal side is shut off by this common mode noise filter 1708.

However, in the conventional twinax cables, there is a disadvantage of intra skew (i.e. a difference in signal propagation clock time between two conductor wires, hereinafter simply referred to as "skew").

In the twinax cable of FIG. 12, since there is a gap (i.e. vacant space, air) A in an outer periphery of the drain wire 1208, when the shield conductor 1207 is wound around the drain wire 1208 and the insulating members 1202, 1205, the drain wire 1208 is compressed or displaced, so that the insulating members 1202, 1205 are crushed. As a result, configurations of the twin insulated electric wires 1203, 1206 are asymmetrical. When the configurations of the insulated electric wires 1203, 1206 are asymmetrical in one pair, the twin conductor wires 1201, 1204 are different in propagation constant from each other, so that attenuation characteristic and phase characteristic in the pair of the conductor wires 1201, 1204 are different from each other. This results in generation of the skew. However, it is necessary to reduce the skew so as to transmit the high speed signals of several Gbps or more in the twinax cable.

The skew is generated due to the difference in propagation constant between the twin conductor wires, and three main factors are assumed as immediate causes thereof.

Factor (1): Physical overall lengths of the twin conductor wires are different from each other.

Factor (2): Dielectric constants per se of the insulating members are different from each other in the pair.

Factor (3): The configurations of the insulating member are asymmetrical in the pair, so that effective dielectric constants in the pair are asymmetrical.

Herein, the "dielectric constant" means a parameter showing the dielectric characteristic of the material per se, and the "effective dielectric constant" means an effective dielectric constant in which influences of an electric field leaking into the space is taken into account. In the case that the electric field occurs only inside of a dielectric material (corresponding to the insulating members 1202, 1205 in the twinax cable of FIG. 12, and the insulating member 1402 in the twinax cable of FIG. 14), it is sufficient to consider the dielectric constant. However, since there is the air in vicinity of the dielectric material in an actual twinax cable and the influence of the electric field generated in the air is not negligible, it is necessary to consider the effective dielectric constant. By way of example only, even in the case that the two insulated electric wires 1203, 1206 having the same dielectric constant are prepared, the effective dielectric constants of the respective insulated electric wires 1203, 1206 will be different from each other when the influences affecting on the two insulated electric wires 1203, 1206 are not equal (asymmetrical) due to the cable configuration or manufacturing process for pairing the two insulated electric wires 1203, 1206.

From the view point of the three main factors as described above, the twinax cables of FIG. 13 to FIG. 15 will be contemplated as below.

In the twinax cable of FIG. 13, a stress acting between the insulated electric wires 1303, 1306 and the drain wire 1308 is dispersed, to control the deformation (crush) of the insulating members 1302, 1305, thereby reducing the asymmetry in configurations of the pair of the insulating members 1302, 1305. However, in case that a location of the drain wire 1308 is shifted in a lateral direction in FIG. 13 due to the inaccuracy in manufacturing, a relationship of forces working between the two insulating members 1302, 1305 will be asymmetrical. Accordingly, the deformation condition of the insulated electric wires 1303, 1306 are not completely symmetrical, so that the twinax cable of FIG. 13 does not have a configuration which is rigid against the production tolerance.

Further, in the twinax cable of FIG. 13, electromagnetic coupling between the drain wire 1308 and the conductor wires 1301, 1304 is enhanced by arranging the drain wire 1308 inside of the shield conductor 1307, so that the electric field distribution in the insulating members 1302, 1305 becomes heterogeneous. Accordingly, the current density distribution of electric current flowing through the conductor wires 1301, 1304 is locally varied. As a result, transmission loss (attenuation) increases.

In the twinax cable of FIG. 14, the two conductor wires 1401, 1404 are collectively coated by the single insulating member 1402, thereby reducing a dielectric constant difference in the insulating member generated in the pair. In addition, a characteristic impedance value of the cable is stable since a location of the drain wire 1408 is uniquely determined. However, similarly to the twinax cable of FIG. 13, the drain wire 1408 is disposed inside of the shield conductor 1407, electromagnetic coupling between the drain wire 1408 and the conductor wires 1401, 1404 is locally enhanced, so that the electric field distribution in the insulating member 1402 becomes heterogeneous. Accordingly, the current density distribution of electric current flowing through the conductor wires 1401, 1404 is locally varied. As a result, transmission loss (attenuation) increases.

In the twinax cable of FIG. 15, the drain wire 1508 is disposed outside of the shield conductor 1507, thereby suppressing increase in transmission loss (attenuation). However, it is difficult to produce the twinax cable of FIG. 15 with keeping a location of the drain wire 1508 in a stable state, since it is necessary to arrange the drain wire 1508 having a circular cross section along an arc part of the insulating member 1402. As a result, unstable positioning of the drain wire 1508 causes the deformation of the insulating member 1502, so that the asymmetry of the pair of the insulating members 1502, 1505 easily occurs.

Further, in the twinax cable of FIG. 15, when the location of the drain wire 1508 is shifted, the shield conductor 1507 deforms to be bent inside to fill the gap A. The deformation of the shield conductor 1507 causes turbulence of the electric field distribution in the insulating members 1502, 1505, so that the transmission loss characteristic becomes unstable. Herein, it is difficult to control the deformation degree of the shield conductor 1507 in manufacturing. In other words, the twinax cable of FIG. 15 has a structure in which the asymmetry occurs in the pair of the insulated electric wires in manufacturing. It is similar in the case that the drain wire 1508 is located on a side of the insulated electric wire 1506, oppositely to the example shown in FIG. 15.

As described above, in the twinax cables of FIG. 13 to FIG. 15, the stability to production tolerance is not considered in improving the three main factors as described above. Further, the problems in the three main factors cannot be solved simultaneously. Still further, an effective solution is not proposed for solving the problem of the increase in transmission loss (attenuation).

In addition, when the conventional twinax cable is connected to the printed circuit board, it is necessary to dispose the GND pad 1603 for connecting the drain wire 1508, between one pair of the signal line pads 1604, 1605 and another pair of the signal line pads 1604, 1605, as shown in FIG. 16. On the other hand, the width P1 of the twinax cable is increased by a width of the drain wire 1508. The packaging density cannot be increased, since the packaging density of the twinax cable on the printed circuit board 1606 depends upon the width P1 of the jacket 1509 of the twinax cable. Further, the connection of the printed circuit board 1606 to the GND pad 1603 in FIG. 16 is not easy, when the drain wire 1208 is disposed in a middle of the conductor wires 1201, 1204, such as the twinax cable of FIG. 12.

Still further, in the conventional twinax cable, the common mode noise filter 1708 is indispensable for composing the transmission line, as shown in FIG. 17.

SUMMARY OF THE INVENTION

Accordingly, it is an object of the present invention to provide a differential signal transmission cable, by which the skew is reduced, the characteristic impedance does not fluctuate in a longitudinal direction of the cable, the transmission loss is suppressed, and which can be stably manufactured.

According to a feature of the invention, a differential signal transmission cable comprises;

two conductor wires disposed to be parallel with each other;

a flat insulating member collectively covering the two conductor wires, the insulating member having flat portions facing to each other in a direction perpendicular to an alignment direction of the two conductor wires to sandwich the two conductor wires;

a shield conductor comprising a metal foil tape, the shield conductor wound around an outer periphery of the insulating member;

a drain wire provided to contact with the shield conductor at a position corresponding to one of the flat portions, and a jacket jacketing the drain wire and the shield conductor.

In the differential signal transmission cable, the drain wire may comprise a rectangular wire conductor.

In the differential signal transmission cable, the drain wire may comprise a flexible flat cable comprising a rectangular wire conductor adhered to a film base material.

In the differential signal transmission cable, the drain wire may comprise a flexible printed circuit board comprising a copper foil adhered to a film base material.

In the differential signal transmission cable, the two conductor wires are located on a center line in a height direction of the insulating member and located to be symmetrical to each other with respect to a center line in a width direction of the insulating member.

In the differential signal transmission cable, it is preferable that a ratio of a distance between the flat portions of the insulating member to a distance between both sides of the insulating member in an alignment direction of the conductor wires is 1:2, and a distance between the two conductor wires is smaller than the distance between the flat portions of the insulating member.

In the differential signal transmission cable, it is preferable that a distance between the two conductor wires and the shield conductor in an alignment direction of the conductor wires is greater than a distance between the two conductor wires and the drain wire.

In the differential signal transmission cable, it is preferable the drain wire is provided at each of the flat portions facing to each other.

In the differential signal transmission cable, it is preferable that a center of the drain wire is located on a center line between both sides of the insulating member in the alignment direction of the two conductor wires.

According to another feature of the invention, a differential signal transmission cable comprises:

two conductor wires disposed to be parallel with each other;

a flat insulating member collectively covering the two conductor wires, the insulating member having flat portions facing to each other in a direction perpendicular to an alignment direction of the two conductor wires to sandwich the two conductor wires;

a drain wire attached to one of the flat portions of the insulating member;

a shield conductor comprising a metal foil tape, the shield conductor wound around an outer periphery of the insulating member to contact with the drain wire; and a jacket jacketing the shield conductor.

In the differential signal transmission cable, the drain wire may comprise a rectangular wire conductor.

In the differential signal transmission cable, the drain wire may comprise a flexible flat cable comprising a rectangular wire conductor adhered to a film base material.

In the differential signal transmission cable, the drain wire may comprise a flexible printed circuit board comprising a copper foil adhered to a film base material.

In the differential signal transmission cable, the two conductor wires are located on a center line in a height direction of the insulating member and located to be symmetrical to each other with respect to a center line in a width direction of the insulating member.

In the differential signal transmission cable, it is preferable that a ratio of a distance between the flat portions of the insulating member to a distance between both sides of the insulating member in an alignment direction of the conductor wires is 1:2, and a distance between the two conductor wires is smaller than the distance between the flat portions of the insulating member.

In the differential signal transmission cable, it is preferable that a distance between the two conductor wires and the shield conductor in an alignment direction of the conductor wires is greater than a distance between the two conductor wires and the drain wire.

In the differential signal transmission cable, it is preferable the drain wire is provided at each of positions corresponding to the flat portions facing to each other.

In the differential signal transmission cable, it is preferable that a center of the drain wire is located on a center line between both sides of the insulating member in the alignment direction of the two conductor wires.

Advantages of the Invention

According to the present invention, following effect can be obtained.

(1) The skew is reduced.

(2) The characteristic impedance does not fluctuate in the longitudinal direction of the cable.

(3) The transmission loss does not increase.

(4) The stable manufacturing is possible.

BRIEF DESCRIPTION OF THE DRAWINGS

The embodiments according to the invention will be explained below referring to the drawings, wherein.

DETAILED DESCRIPTION OF THE EMBODIMENTS

Next, a differential signal transmission cable in the embodiments according to the present invention will be explained below in more detail in conjunction with the appended drawings.

First Embodiment

Figure 1:
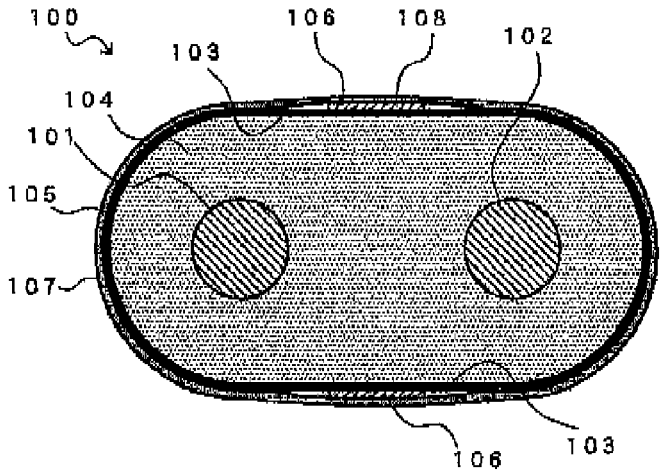
FIG. 1 is a cross-sectional view of a differential signal transmission cable in the first embodiment according to the present invention.

FIG. 1 is a cross-sectional view of a differential signal transmission cable in the first embodiment according to the present invention.

Referring to FIG. 1, a differential signal transmission cable 100 in the first embodiment according to the present invention comprises two conductor wires 101, 102 disposed to be parallel with each other, a flat insulating member 104 collectively covering the two conductor wires 101, 102, the insulating member 104 having flat portions 103 facing to each other in a direction perpendicular (vertical direction in FIG. 1) to an alignment direction (horizontal direction in FIG. 1) of the two conductor wires 101, 102 to sandwich the two conductor wires 101, 102, a shield conductor 105 comprising a metal foil tape and being wound around an outer periphery of the insulating member 104, a drain wire 106 provided to contact with the shield conductor 105 at a position corresponding to the flat portions 103, and a jacket 107 jacketing the drain wire 106 and the shield conductor 105.

In the differential signal transmission cable 100, the two conductor wires 101, 102 provided as one pair for differential signal transmission are disposed to be parallel with each other, namely, geometrically in parallel. The conductor wires 101, 102 are collectively coated with the insulating member 104 having a flat cross section. The widthwise cross section of the insulating member 104 is an elliptical shape combining two straight lines extended in the alignment direction of the two conductor wires 101, 102 with semi circles located on both sides in the alignment direction of the conductor wires 101, 102. The flat portion 103 is composed of a part having a linear cross section in the insulating member 104. The conductor wires 101, 102 and the insulating member 104 are collectively formed by extrusion-molding.

As a material of the insulating member 104, it is preferable to use a material with a low dielectric constant and a low dielectric dissipation factor (dielectric tangent), e.g. polytetrafluoroethylene (PTFE), perfluoroalkoxy (PFA), polyethylene and the like. In addition, a foamable insulative resin may be used as the material of the insulating member 104, in order to lower the dielectric constant and the dielectric dissipation factor. In the case of using the foamable insulative resin, there are several methods, e.g. a method of mixing a foamable agent into a resin before molding and controlling a foaming level of the resin by a molding temperature, a method of injecting a gas such as nitrogen into a resin by a molding pressure and foaming the resin at the time of pressure releasing, and the like.

The shield conductor 105 comprising the metal foil tape is wound around the outer periphery of the insulating member 104. Since there is no irregularity (convexo-concave part) which may generate a gap at a part which the shield conductor 105 is wound around, namely, a surface of the insulating member 104, the shield conductor 105 is wound without clearance (gap) on the surface of the insulating member 104. As a metallic material of the metal foil tape used for the shield conductor 105, it is preferable to use aluminum, copper and the like.

On an outer surface of the shield conductor 105, the drain wire 106 comprising a rectangular wire conductor 108 is disposed along a longitudinal direction of the differential signal transmission cable 100 (i.e. a depth direction in FIG. 1) to contact with the shield conductor 105.

Following functions and effects can be obtained according to the differential signal transmission cable 100.

In the differential signal transmission cable 100, since the two conductor wires 101, 102 are disposed to be parallel with each other, it is possible to manufacture the differential signal transmission cable 100 in the state that the physical overall lengths of the conductor wires 101, 102 are equal to each other. According to this structure, the difference in physical overall length between the twin conductor wires, which is the factor (1), can be overcome.

In the differential signal transmission cable 100, the two conductor wires 101, 102 and the insulating member 104 are collectively formed by extrusion-molding, so that there is no difference in dielectric constant of the insulating member 104 with respect to the conductor wires 101, 102. According to this structure, the difference in dielectric constant in the insulating member, which is the factor (2), can be overcome.

In the differential signal transmission cable 100, the shield conductor 105 is wound around the outer periphery of the insulating member 104 without clearance. In other words, there is no gap A which exists in the conventional device. Therefore, even if some deformation occurs in the insulating member 104, there will be no adverse effect of the gap (air: a specific dielectric constant is 1.0). As a result, a large change in the effective dielectric constant will not be observed. In other words, the asymmetry in the effective dielectric constant hardly occurs.

Further, in the differential signal transmission cable 100, the shield conductor 105 is wound around the outer periphery of the flat insulating member 104 having the flat portions 103, and the drain wire 106 is attached to contact with the shield conductor 105 at the flat portions 103. Therefore, there is no gap at an inside part with respect to the shield conductor 105, the shape of the differential signal transmission cable 100 hardly deforms at the time of manufacturing and after the manufacturing.

According to this structure, the asymmetry of the effective dielectric constant in the pair due to the asymmetry in the configuration of the insulating member in the pair, which is the factor (3), can be overcome.

As described above, according to the differential signal transmission cable 100 of the present invention, it is possible to reduce the skew by simultaneously solving the three main factors (1) to (3). Accordingly, it is possible to realize the high speed signal transmission between the devices or in the device to which the differential signal transmission cable 100 is applied, thereby improving performance of the electronic equipments.

In the differential signal transmission cable 100, since the two conductor wires 101, 102 are disposed to be parallel with each other, it is possible to manufacture the differential signal transmission cable 100 in the state that the physical overall lengths of the conductor wires 101, 102 are equal to each other In the differential signal transmission cable 100, the two conductor wires 101, 102 and the insulating member 104 are collectively formed by extrusion-molding, so that it is possible to form the insulating member 104 without the asymmetry of the dielectric constant in the insulating member.

In the differential signal transmission cable 100, since the widthwise cross section of the insulating member 104 is elliptical, there is no gap inside the insulating member 104, and the insulating member 104 entirely comprises the same material uniformly. Even if an external force acts on the insulating member 104, the effective dielectric constant will not be asymmetrical in the pair, since the insulating member 104 is composed of the same material uniformly without including any gap.

In the differential signal transmission cable 100, the two conductor wires 101, 102 and the insulating member 104 are collectively formed by extrusion-molding, so that it is possible to manufacture the differential signal transmission cable 100 by stably controlling a distance between the two conductor wires 101, 102 and a distance between the insulating member 104 and the two conductor wires 101, 102. Therefore, the differential signal transmission cable 100 can be manufactured with a uniform quality.

In the differential signal transmission cable 100, a common mode impedance can be increased without changing a differential mode impedance, by controlling the distance between the two conductor wires 101, 102 and the distance between the insulating member 104 and the two conductor wires 101, 102. This effect will be described in more detail as follows.

A differential mode is a mode propagated by an electric field which occurs between the conductor wires 101, 102, and a common mode is a mode propagated by an electric field which occurs between the conductor wires 101, 102 and the shield conductor 105. The differential mode propagates in accordance with an impedance determined between the two conductor wires 101, 102, and the common mode propagates in accordance with an impedance determined between the shield conductor 105 and the conductor wires 101, 102. Accordingly, in the present invention, the fact "the distance between the two conductor wires 101, 102 and the distance between the insulating member 104 and the two conductor wires 101, 102 can be stably controlled" means that the differential mode impedance an the common mode impedance can be respectively controlled.

In general, when the modes propagating through a differential signal transmission cable are considered, an energy conversion phenomenon occurring between the differential mode which is a signal component and the common mode which is a noise component can be observed as one of the electric characteristics. This energy conversion phenomenon is referred to as "mode conversion", and an energy amount relating to the mode conversion is referred to as "amount of mode conversion". The mode propagating through the differential signal transmission cable is propagated with repeating a conversion from the differential mode to the common mode and a conversion from the common mode to the differential mode.

When the amount of the mode conversion is large, a phase shift caused by the mode conversion increases, thereby causing the asymmetry of phase characteristics in one pair. The phase shift at this time largely affects on the skew. Therefore, if the amount of the mode conversion can be reduced, the phase shift caused thereby will be reduced, so that the skew will be reduced. It is necessary to attenuate enough a common mode component, which is one of factors for generating the skew, without attenuating a differential mode component which is the signal, in order to reduce the amount of the mode conversion, namely, the skew.

As to the above problem, according to the differential signal transmission cable 100, only the common mode impedance can be increased without changing the differential mode impedance by satisfying following preferred conditions.

Preferred Conditions

Figure 2:
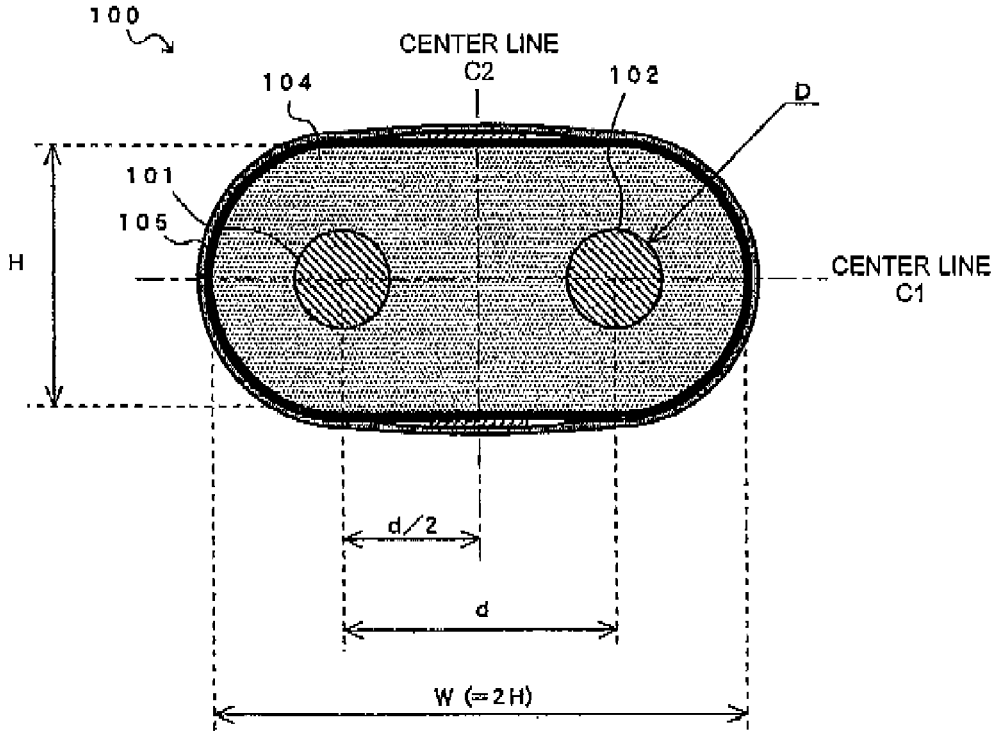
FIG. 2 is a cross-sectional view of the differential signal transmission cable of FIG. 1 to which definitions of dimensions for realizing preferred conditions are added.

FIG. 2 is a cross-sectional view of the differential signal transmission cable 100 of FIG. 1 to which definitions of dimensions for realizing preferred conditions are added.

Referring to FIG. 2, the differential signal transmission cable 100 comprises preferred conditions to realize desired characteristics.

The preferred conditions are provided by controlling a distance H between the flat portions 103 of the insulating member 104 (hereinafter referred to as "height of the insulating member 104"), a distance W between the both sides in the alignment direction of the conductor wires 101, 102 of the insulating member 104 (hereinafter referred to as "width of the insulating member 104"), the distance d between the two conductor wires 101, 102, and a diameter D of the conductor wires 101, 102.

As shown in FIG. 2, the diameter D of the conductor wires 101, 102 and the distance d between the conductor wires 101, 102 are determined in such a manner that the differential mode impedance becomes a predetermined value (in most cases, the predetermined value is a value of the impedance determined at a side of a system using the differential signal transmission cable) and that the common mode impedance becomes large. Thereby, the electromagnetic coupling state between the two conductor wires 101, 102 can be controlled by keeping the differential mode impedance at the predetermined value.

When the electromagnetic coupling between the two conductor wires 101, 102 is strengthened by reducing the distance d between the conductor wires 101, 102, the mode conversion between the differential mode and the common mode hardly occurs. Namely, in an energy input to the differential signal transmission cable 100 as the differential mode, a proportion of an energy propagating as the differential mode without being converted into the common mode is increased. Thereby, the adverse effect of the phase shift on the differential mode which is the signal component is reduced, so that the skew is reduced.

Further, it is preferable that both of the two conductor wires 101, 102 are located on a center line C1 in a height direction of the insulating member 104 (i.e. a center line between the flat portions 103 of the insulating member 104), and that the conductor wires 101, 102 are located to be symmetrical to each other with respect to a center line C2 in a width direction of the insulating member 104 (i.e. a center line between the both sides in the alignment direction of the conductor wires 101, 102). In other words, a distance between the center line C2 in the width direction of the insulating member 104 and the conductor wires 101, 102 is a half of the distance d between the conductor wires 101, 102 (d/2). This is a necessary condition for realizing that a distance between the shield conductor 105 and the conductor wire 101 and a distance between the shield conductor 105 and the conductor wire 102 are equal to each other. The asymmetry of the effective dielectric constant which occurs between the conductor wires 101, 102 can be prevented by satisfying this condition. It is more preferable that a center of the drain wire 106 is located at the center line C2.

Variation of the First Embodiment

Figure 3:
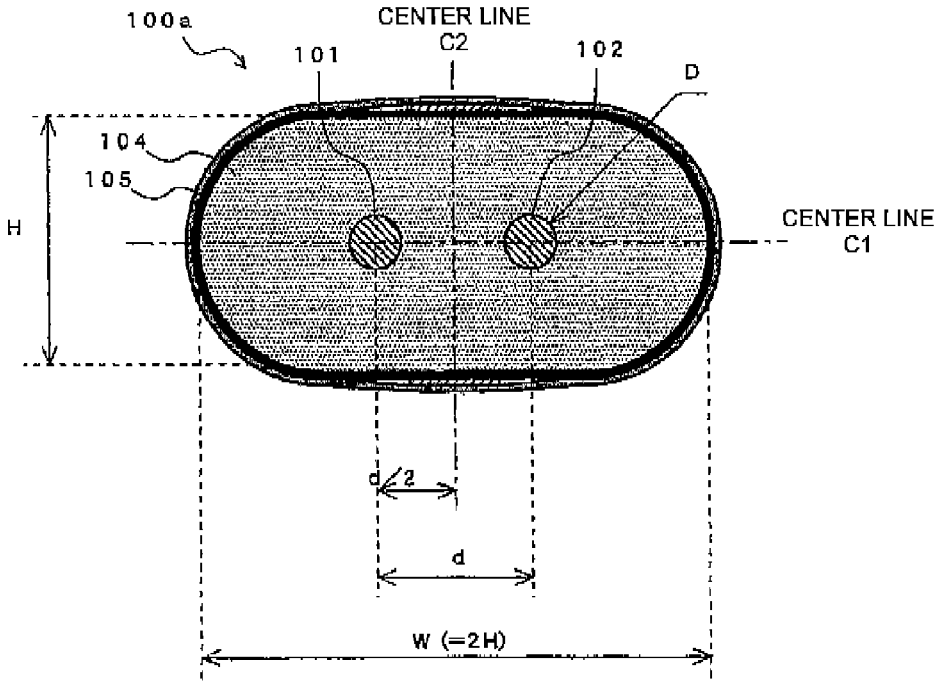
FIG. 3 is a cross-section view of a differential signal transmission cable in which a diameter D of each conductor wire is reduced and a conductor wire distance d is changed compared with the differential signal transmission cable of FIG. 1.

FIG. 3 is a cross-section view of a differential signal transmission cable 100*a* in which a diameter D of each conductor wire is reduced and a conductor wire distance d is changed compared with the differential signal transmission cable 100 of FIG. 2.

In the differential signal transmission cable 100*a* as shown in FIG. 3, the diameter D of the conductor wires 101, 102 is reduced and the distance d between the conductor wires 101, 102 is reduced compared with those in the differential signal transmission cable 100 of FIG. 2.

In order to increase the common mode impedance while keeping the differential mode impedance at the predetermined value, it is preferable to set a ratio of the height H of the insulating member 104 to the width W of the insulating member 104 as 1:2 (i.e. W=2H) and to set the distance d between the two conductor wires 101, 102 to be smaller than the height H of the insulating member 104.

Figure 12:
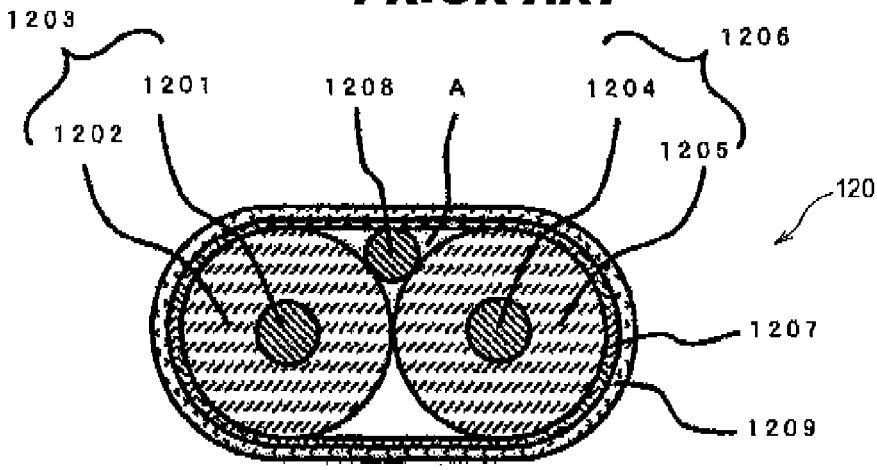
FIG.12 PRIOR ART
FIG. 12 is a cross-sectional view of the first conventional twinax cable.
Figure 13:
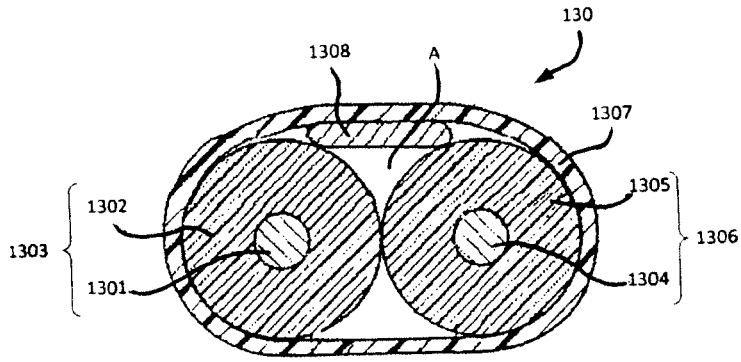
FIG.13 PRIOR ART
FIG. 13 is a cross-sectional view of the second conventional twinax cable.
Figure 14:
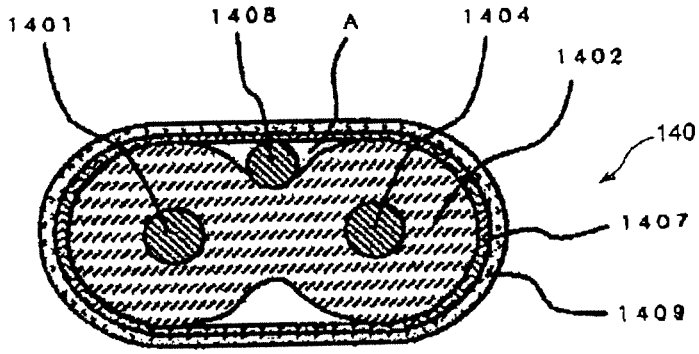
FIG.14 PRIOR ART
FIG. 14 is a cross-sectional view of the third conventional twinax cable.
Figure 15:
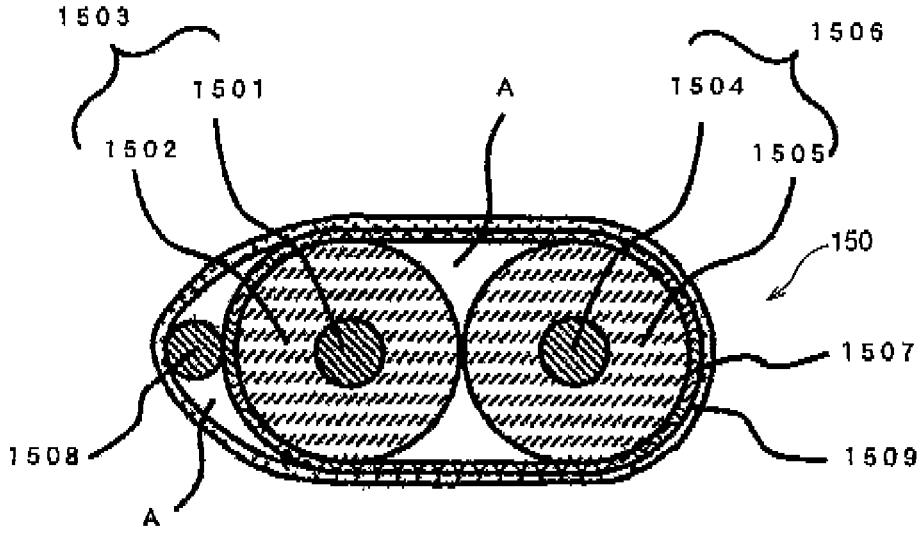
FIG.15 PRIOR ART
FIG. 15 is a cross-sectional view of the fourth conventional twinax cable.

Returning to FIG. 12, in the conventional twinax cable 120, the two insulated electric wires 1203, 1204 are arranged, in which each of the conductor wires 1201, 1204 and each of the insulating members 1202, 1204 are concentrically located. In this structure, dimensions of the aligned two insulated electric wire 1203, 1206 are expressed as a width of 2 to a height of 1 (width:height=2:1). The two conductor wires 1201, 1204 are necessarily distant from each other by a distance corresponding to a diameter of the insulating members 1202, 1205. In order to strengthen the electromagnetic coupling between the conductor wires 1201, 1204, it is necessary to reduce the distance between the two conductor wires 1201, 1204 (i.e. to set the distance between the conductor wires 1201, 1204 to be smaller than the diameter of the insulating members 1202, 1205), and to increase the distance between the shield conductor 1207 and the conductor wires 1201, 1204 (i.e. to set the distance between the shield conductor 1207 and the conductor wires 1201, 1204 to be greater than a radius of the insulating members 1202, 1205). However, in the conventional twinax cable 120, the insulated electric wires 1203, 1206 are aligned to contact with each other. Therefore, it is impossible to further reduce the distance between the conductor wires 1201, 1204.

On the other hand, in the differential signal transmission cable 100*a* as shown in FIG. 3, the diameter D of the conductor wires 101, 102 is reduced and the distance d between the conductor wires 101, 102 is reduced. In this case, the electromagnetic coupling state between the shield conductor 105 and the conductor wires 101, 102 is substantially same as that in the differential signal transmission cable 100 of FIG. 2 in the height direction of the insulating member 104, and weaker than that in the differential signal transmission cable 100 of FIG. 2 in the width direction of the insulating member 104. In other words, the impedance between the shield conductor 105 and the conductor wires 101, 102 (i.e. the common mode impedance) is increased in the differential signal transmission cable 100*a*.

EXAMPLES

For the purpose of confirming the above contemplation, several kinds of samples of the differential signal transmission cable 100*a* as shown in FIG. 3 were prepared. In the samples, the diameter D of the conductor wires 101, 102 and the distance d between the conductor wires 101, 102 were changed in such a manner that the differential mode impedance is 100Ω. Characteristics of the respective samples were evaluated as follows. The height H of the insulating member 104 was 0.74 mm and the width W was 1.48 mm. As the insulating member 104, perfluoroalkoxy (PFA with a specific dielectric constant of 2.1) was used. A 4-port network analyzer was used for analysis of the transmission loss. A TDR (Time Domain Reflectometry) measuring apparatus using a pulse signal with a rising time (leading-edge time) of 35 ps was used for analysis of the skew.

TABLE 1 shows a measurement result of the common mode impedance when conductor wire 101 in FIG. 3, the diameter D of the conductor wires 101, 102 and the distance d between the conductor wires 101, 102 were changed.

TABLE 1

| | Diameter D of conductor wire [mm] | Distance d between conductor wires [mm] | Differential mode impedance [Ω] | Common mode impedance [Ω] |
|---|---|---|---|---|
| Example 1 | 0.226 | 0.740 | 100 | 28 |
| Example 2 | 0.200 | 0.440 | 100 | 37 |
| Example 3 | 0.190 | 0.375 | 100 | 41 |
| Example 4 | 0.141 | 0.275 | 100 | 51 |

From the measurement result in TABLE 1, it is confirmed that it is possible to increase the common mode impedance while keeping the differential mode impedance at the predetermined value (100Ω), by reducing the diameter D of the conductor wires 101, 102 and reducing the distance d between the conductor wires 101, 102. In other words, it is confirmed that the electromagnetic coupling state between the conductor wires 101, 102 can be strengthened.

Figure 4:
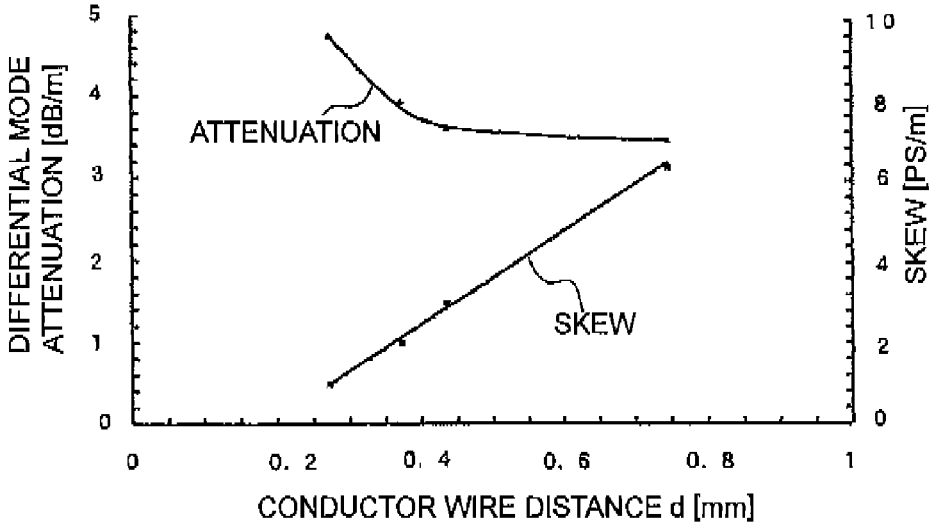
FIG. 4 is a graph showing changes of differential mode attenuation and skew in the differential signal transmission cable of FIG. 3 when the conductor wire distance d is changed.

FIG. 4 is a graph showing changes of the differential mode transmission loss (attenuation) and the skew in the differential signal transmission cable 100*a* with a cable length of 1 m when the diameter D of the conductor wires 101, 102 and the distance d between the conductor wire 101, 102 were changed. It is actually confirmed from FIG. 4 that the skew is reduced, in accordance with decrease in the diameter D of the conductor wires 101, 102 and decrease in the distance d between the conductor wires 101, 102, namely, in accordance with the enhancement of the electromagnetic coupling. In addition, it is confirmed that there is a particular range of the distance d between the conductor wires 101, 102, in which an increase in the differential mode transmission loss is not so large. This means that even if the electromagnetic coupling state between the conductor wires 101, 102 is slightly strengthened, the enhancement of the electromagnetic coupling does not affect the transmission until a certain range. In other words, it is possible to realize the differential signal transmission cable 100*a* in which the increase in the transmission loss is negligible although the electromagnetic coupling state between the conductor wires 101, 102 is strengthened, by selecting the distance d between the conductor wires 101, 102 in designing the cable.

As described above, according to the differential signal transmission cable 100*a* of FIG. 3 which is the variation of the differential signal transmission cable 100 of FIG. 2, only the common mode impedance can be increased without changing the differential mode impedance, thereby reducing the skew can be reduced.

Next, other embodiments of the present invention will be explained below.

Second Embodiment

Figure 5:
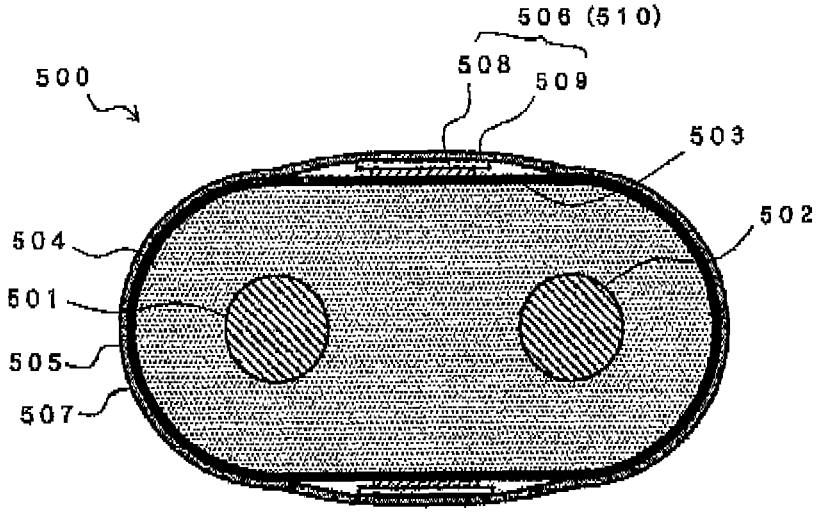
FIG. 5 is a cross-sectional view of a differential signal transmission cable in the second embodiment according to the present invention.

FIG. 5 is a cross-sectional view of a differential signal transmission cable 500 in the second embodiment according to the present invention.

Referring to FIG. 5, similarly to the differential signal transmission cable 100 of FIG. 1, a differential signal transmission cable 500 in the second embodiment according to the present invention comprises two conductor wires 501, 502 disposed to be parallel with each other, a flat insulating member 504 collectively covering the two conductor wires 501, 502, the insulating member 504 having flat portions 503 and having a flat cross section, a shield conductor 505 wound around an outer periphery of the insulating member 504, and a drain wire 506 provided at an outer periphery of the shield conductor 505 to contact with the shield conductor 505.

The second embodiment is similar to the first embodiment except the drain wire 506. As the drain wire 506, an FFC (Flexible Flat Cable) 510 with a configuration, in which a rectangular wire conductor 508 is adhered to a film base material 509, and a part of the rectangular wire conductor 508 is exposed from the FFC 510, is used. Further, the drain wire 506 and the shield conductor 505 are jacketed by a jacket 507.

Third Embodiment

Figure 6:
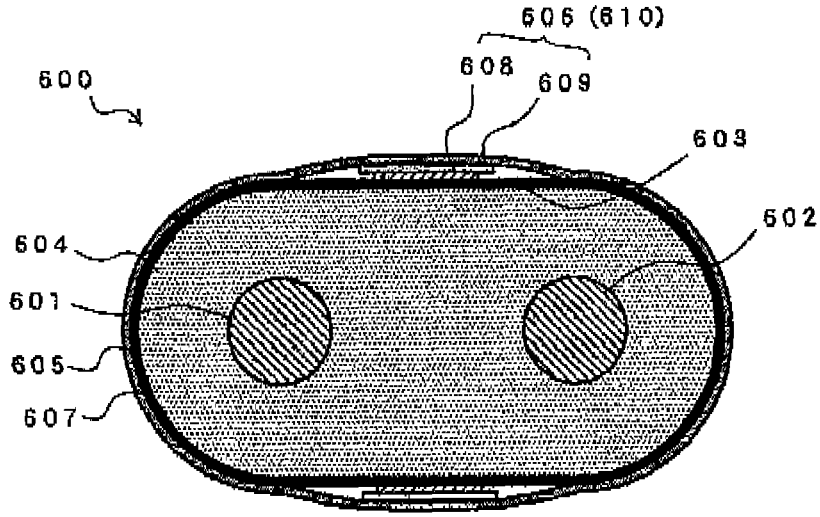
FIG. 6 is a cross-sectional view of a differential signal transmission cable in the third embodiment according to the present invention.

FIG. 6 is a cross-sectional view of a differential signal transmission cable 600 in the third embodiment according to the present invention.

Referring to FIG. 6, similarly to the differential signal transmission cable 100 of FIG. 1, a differential signal transmission cable 600 in the third embodiment according to the present invention comprises two conductor wires 601, 602 disposed to be parallel with each other, a flat insulating member 604 collectively coveting the two conductor wires 601, 602, the insulating member 604 having flat portions 603 and having a flat cross section, a shield conductor 605 wound around an outer periphery of the insulating member 604, and a drain wire 606 provided at an outer periphery of the shield conductor 605 to contact with the shield conductor 605.

The third embodiment is similar to the first embodiment except the drain wire 606. As the drain wire 606, an FPC (Flexible Printed Circuit Board) 610 with a configuration, in which a copper foil 608 is adhered to a film base material 609, and the copper foil 608 is exposed to the outside, is used. The drain wire 606 and the shield conductor 605 are jacketed by a jacket 607.

Fourth Embodiment

Figure 7:
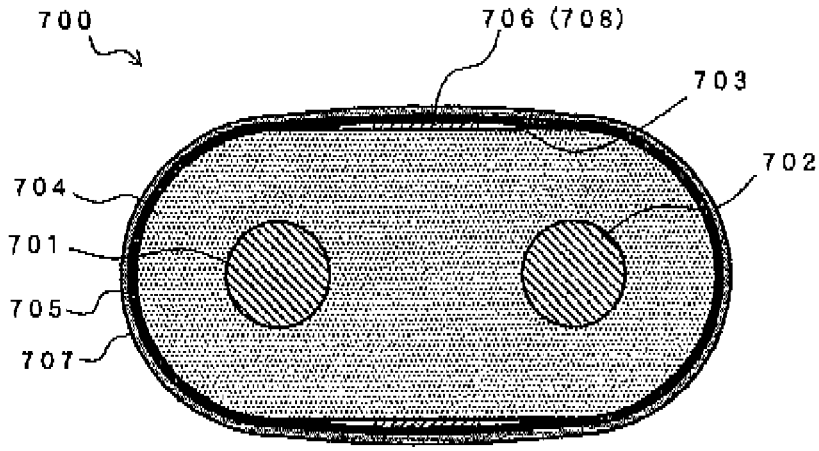
FIG. 7 is a cross-sectional view of a differential signal transmission cable in the fourth embodiment according to the present invention.

FIG. 7 is a cross-sectional view of a differential signal transmission cable 700 in the fourth embodiment according to the present invention.

Referring to FIG. 7, similarly to the differential signal transmission cable 100 of FIG. 1, a differential signal transmission cable 700 in the fourth embodiment according to the present invention comprises two conductor wires 701, 702 disposed to be parallel with each other, and a flat insulating member 704 collectively covering the two conductor wires 701, 702, the insulating member 704 having flat portions 703 and having a fiat cross section.

The differential signal transmission cable 700 of FIG. 7 is different from the differential signal transmission cable 100 of FIG. 1, in that a drain wire 706 is attached to flat portion 703 of the insulating member 704, a shield conductor 705 is wound around an outer periphery of the insulating member 704 to contact with the drawing wire 706, the shield conductor 705 is jacketed by a jacket 707. As the drain wire 706, a single body of a rectangular wire conductor 708 is used.

Fifth Embodiment

Figure 8:
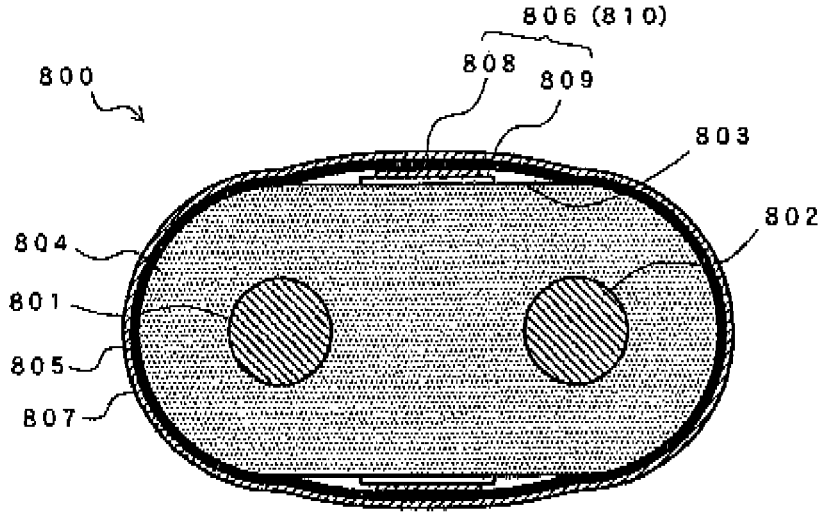
FIG. 8 is a cross-sectional view of a differential signal transmission cable in the fifth embodiment according to the present invention.

FIG. 8 is a cross-sectional view of a differential signal transmission cable 800 in the fifth embodiment according to the present invention.

Referring to FIG. 8, similarly to the differential signal transmission cable 700 of FIG. 7 in the seventh embodiment, a differential signal transmission cable 800 in the fifth embodiment according to the present invention comprises two conductor wires 801, 802 disposed to be parallel with each other, a flat insulating member 804 collectively covering the two conductor wires 801, 802, the insulating member 804 having flat portions 503 and having a flat cross section, a drain wire 806 attached to the flat portion 803 of the insulating member 804, a shield conductor 805 wound around an outer periphery of the insulating member 804 to contact with the drawing wire 806, and a jacket 807 jacketing the shield conductor 805.

The fifth embodiment is similar to the fourth embodiment except the drain wire 806. As the drain wire 806, an FFC (Flexible Flat Cable) 810 with a configuration, in which a rectangular wire conductor 808 is adhered to a film base material 809, and a part of the rectangular wire conductor 808 is exposed from the FFC 810, is used.

Instead of the FFC 810, an FPC (Flexible Printed Circuit Board) with a configuration in which a copper foil is adhered to a film base material, and a part of copper foil was exposed from the FPC may be used.

Functions and Effects of the Second to Fifth Embodiments

The differential signal transmission cables 500, 600, 700, and 800 of FIGS. 5 to 8 in the second to fifth embodiments provides functions and effects similar to those of the differential signal transmission cable 100 of FIG. 1 in the first embodiment.

In the differential signal transmission cable 500 (600, 700, and 800), the common mode impedance can be increased by reducing the diameter D of the conductor wires 501, 502 and the distance d between the conductor wires 501, 502, similarly to the variation of the first embodiment as explained referring to FIG. 3.

In the differential signal transmission cable 700 of FIG. 7, there is some gap A between the shield conductor 705 and the insulating member 704. However, when a ratio of a height of the insulating member 704 to a width of the insulating member 704 is 1:2 (i.e. W=2H), an electromagnetic coupling between the shield conductor 705 and the conductor wires 701, 702 is greater than an electromagnetic coupling between the rectangular wire conductor 708 as the drain wire 706 and the conductor wires 701, 702. Therefore, the presence of the gap A is almost negligible, so that the effective dielectric constant in the pair will not be asymmetrical due to the adverse effect of the gap A. It is similar in the case of the differential signal transmission cable 800 of FIG. 8.

As described above, the electromagnetic coupling between the shield conductor 705 and the conductor wires 701, 702 is greater than the electromagnetic coupling between the drain wire 706 and the conductor wires 701, 702, when a ratio of a height H to a width W is 1:2. It is because that the shield conductor 705 is located to be closer to the conductor wires 701, 702 than the drain wire 706. Namely, a distance between the shield conductor 705 and the conductor wires 701, 702 is smaller than a distance between the drain wire 706 and the conductor wires 701, 702. When W>2H is established with keeping the distance d between the conductor wires 701, 702 at the same value as that in FIG. 7, a relative distance between the shield conductor 705 and the conductor wires 701, 702 is increased, so that the drain wire 706 and the conductor wire 701, 702 are strongly coupled with each other. Therefore, the adverse effect of the gap A in vicinity of the drain wire 706 contacting to the shield conductor 705 is increased compared with the case of W=2H, so that the asymmetry in the effective dielectric constant in the pair occurs more easily. On the contrary, when W<2H is established, the relative distance between the shield conductor 705 and the conductor wires 701, 702 is decreased, so that the electromagnetic coupling between the drain wire 706 and the conductor wires 701, 702 is weakened. In this case, the adverse effect of the gap A in the vicinity of the drain wire 706 is decreased compared with the case of W=2H. On the other hand, the electric field between the shield conductor 705 and the conductor wires 101, 102 is strengthened so that the common mode impedance is increased. As a result, the signal transmission is more affected by the common mode noise.

(Applications of the Differential Signal Transmission Cable)

Next, an application example of the differential signal transmission cable 100 of the present invention which is connected to a printed circuit board by soldering will be explained below.

Figure 9:
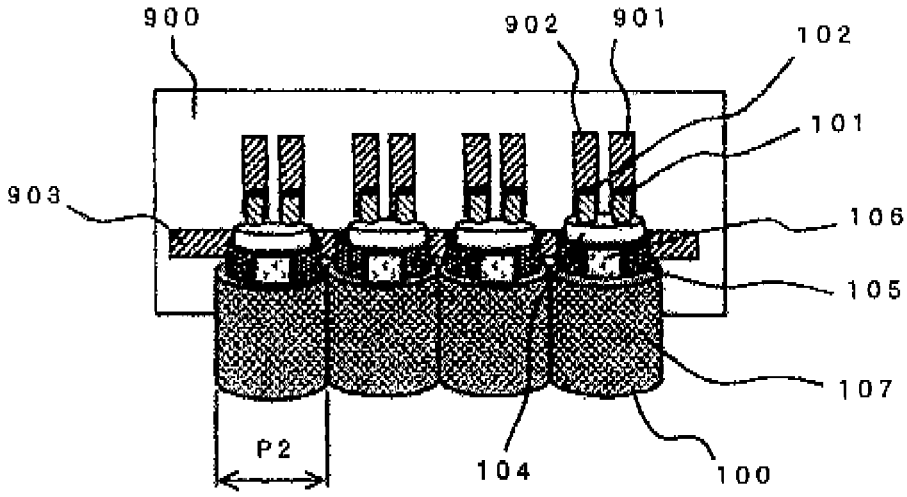
FIG. 9 is a perspective view showing the first application of the differential signal transmission cable, in which the differential signal transmission cable of the present invention is connected by soldering to a printed circuit board.

FIG. 9 is a perspective view showing the first application of the differential signal transmission cable, in which the differential signal transmission cable 100 of the present invention is connected by soldering to a printed circuit board 900.

Figure 16:
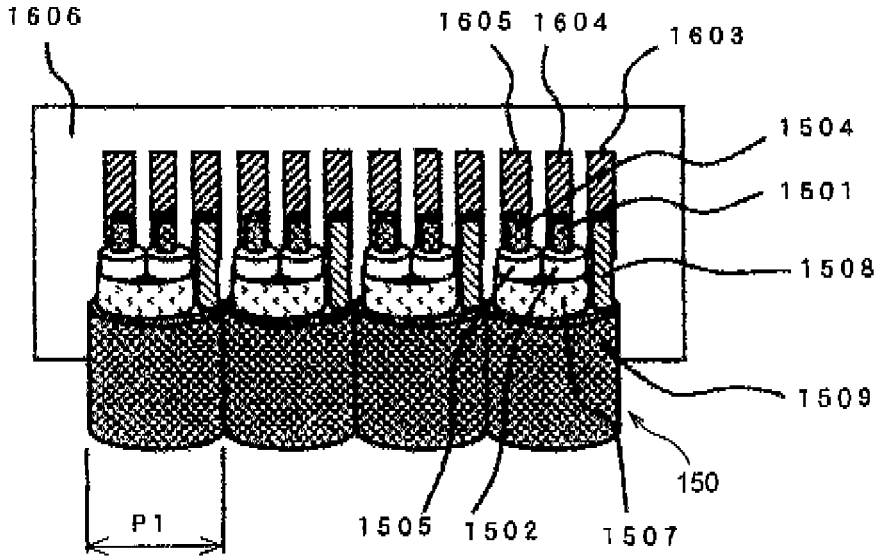
FIG.16 PRIOR ART
FIG. 16 is a perspective view showing the example of connecting the conventional twinax cable to the printed circuit board by soldering.

Referring to FIG. 9, plural pairs of signal line pads 901, 902 and a common GND pad 903 are formed on the printed circuit board 900. An interval between the signal line pads 901, 902 is equal to the distance d between the conductor wires 101, 102 of the differential signal transmission cable 100, and a pitch between the respective pairs of the signal line pads 901, 902 is equal to the width P2 of the differential signal transmission cable 100. The GND pad 903 is formed to be lengthy in an alignment direction of the signal line pads 901, 902. Thereby, the conductor wires 101, 102 can be easily connected to the signal line pads 901, 902 by soldering. In addition, a part of the jacket 107 at one end of the differential signal transmission cable 100 is exfoliated to expose a part of the drain wire 106. Therefore, the drain wire 6 can be easily connected to the GND pad 903 by soldering. Further, in the differential signal transmission cable 100, the width P2 can be reduced compared with a width P1 of the conventional twinax cable shown in FIG. 16, since the drain wire 106 is disposed on the flat portion 103 of the shield conductor 105. Accordingly, it is possible to increase the packaging density of a plurality of the differential signal transmission cables 100 connected to the printed circuit board 900 by using the differential signal transmission cable 100.

Figure 10:
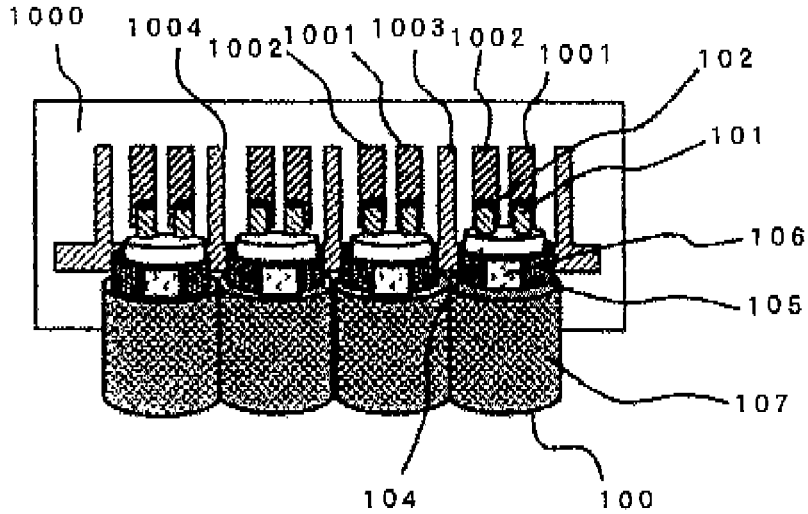
FIG. 10 is a perspective view showing the second application of the differential signal transmission cable, in which the differential signal transmission cable of the present invention is connected by soldering to a printed circuit board.

FIG. 10 is a perspective view showing the second application of the differential signal transmission cable, in which the differential signal transmission cable 100 of the present invention is connected by soldering to a printed circuit board 1000.

Referring to FIG. 10, plural pairs of signal line pads 1001, 1002 and a common GND pad 1003 are formed on the printed circuit board 1000. In the GND pad 1003, shield walls 1004 to partition the respective pairs of the signal line pads 1001, 1002 are formed to be branched. The effect of realizing the easy soldering and the effect of increasing the packaging density are same as those in the application shown in FIG. 9. Further, when the electromagnetic coupling between a pair of the signal line pads 1001, 1002 and another pair of the signal line pads 1001, 1002 adjacent to each other occurs, a noise component called as crosstalk is generated. According to the structure shown in FIG. 10, an effect of reducing the crosstalk can be obtained by the shield walls 1004.

In the case that the differential signal transmission cables 500, 600, 700, and 800 are used in the structures shown in FIGS. 9 and 10, the functions and effects similar to those in the case of using the differential signal transmission cable 100 can be provided.

Next, a transmission line to which the differential signal transmission cable 100 of the present invention is applied will be explained below.

Figure 11:
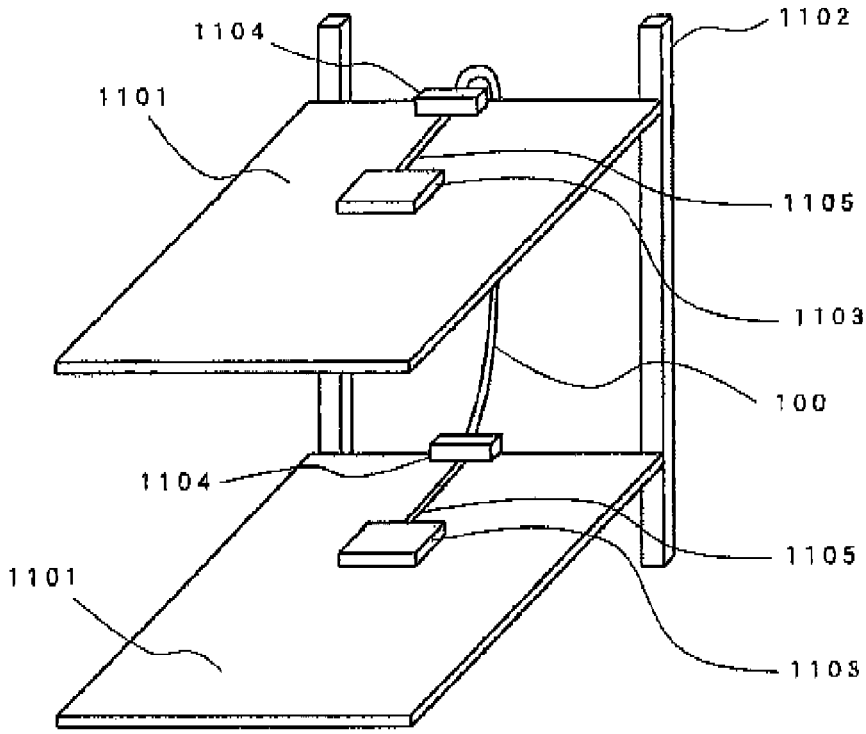
FIG. 11 is a perspective view showing the application of the differential signal transmission cable of the present invention to a transmission line.

FIG. 11 is a perspective view showing the application of the differential signal transmission cable of the present invention to a transmission line.

Referring to FIG. 11, two line cards 1101 arranged at an upper position and a lower position are horizontally held by shafts (supporting mechanism) 1102. A transceiver IC 1103 and a connector 1104 are mounted on each of the line cards 1101, and a wiring pattern 1105 from the transceiver IC 1103 to the connector 1104 is formed on the line card 1101. ken of upper and lower connector is cabled by differential signal transmission cable 100. The respective connectors 1104 mounted on the upper and lower line cards 1101 are interconnected by the differential signal transmission cable 100. A differential signal transmitted from the transceiver IC 1103 of the upper line card 1101 is transmitted through the wiring patter 1105 and via the connector 1104 to the differential signal transmission cable 100, and further transmitted from the differential signal transmission cable 1001 via the connector 1104 of the lower line card 1101 and through the wiring pattern 1105 to the transceiver IC 1103 as a receiving terminal.

Figure 17:
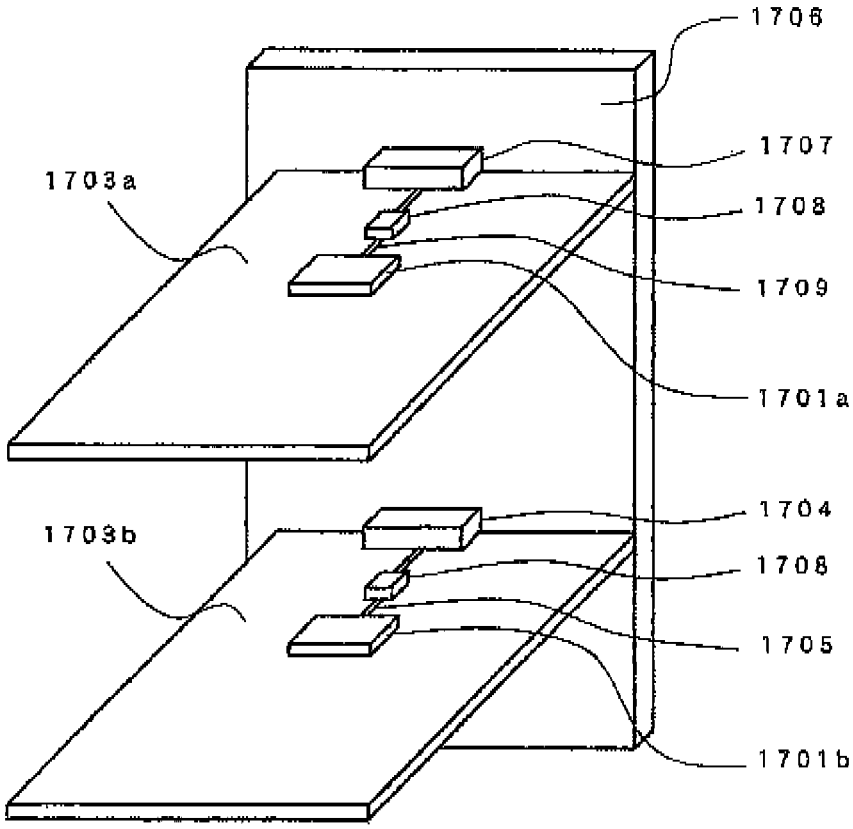
FIG.17 PRIOR ART
FIG. 17 is a perspective view of the transmission line using the conventional printed circuit board.

As explained above, the common mode impedance is large in the differential signal transmission cable 100, the common mode component attenuates in propagating through the differential signal transmission cable 100. As a result, the differential signal transmission cable 100 provides the same functions as the common mode noise filter. Thereby, it is possible to omit the common mode noise filter (cf. FIG. 17) that has been necessary in the conventional twinax cable. Further, in the transmission line shown in FIG. 11, a backplane board (cf. FIG. 17) that has been used in the conventional transmission line (seven FIG. 1 cross-reference) is omitted, and the connectors 1104 of the upper and lower line cards 1101 are interconnected by the differential signal transmission cable 100. Since the backplane board is very expensive, it is possible to remarkably reduce the cost by replacing the backplane board with the differential signal transmission cable 100.

In the case that the differential signal transmission cables 500, 600, 700, and 800 are used in the structures shown in FIG. 11, the functions and effects similar to those in the case of using the differential signal transmission cable 100 can be provided.

In addition, it is possible to realize a single multi-conductor cable comprising a plurality of differential signal transmission cables 100, 500, 600, 700, 800 of the present invention. It is possible to realize a Direct Attach cable harness for directly connecting a connector of the multi-conductor cable to a printed circuit board to the other end, by assembling a connector in such a multi-conductor cable.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A differential signal transmission cable comprising:

two conductor wires disposed to be parallel with each other;

a flat insulating member collectively covering the two conductor wires, the insulating member having flat portions facing each other in a direction perpendicular to an alignment direction of the two conductor wires to sandwich the two conductor wires;

a shield conductor comprising a metal foil tape, the shield conductor wound around an outer periphery of the insulating member;

a drain wire provided to contact with the shield conductor at a position corresponding to one of the flat portions, and a jacket jacketing the drain wire and the shield conductor, wherein a ratio of a distance between the flat portions of the insulating member to a distance between both sides of the insulating member in the alignment direction of the conductor wires is 1:2, and a distance between the two conductor wires is smaller than the distance between the flat portions of the insulating member.

2. The differential signal transmission cable according to claim 1, wherein the drain wire comprises a flexible flat cable comprising a rectangular wire conductor adhered to a film base material.

3. The differential signal transmission cable according to claim 1, wherein the drain wire comprises a flexible printed circuit board comprising a copper foil adhered to a film base material.

4. The differential signal transmission cable according to claim 1, wherein the two conductor wires are located on a center line in a height direction of the insulating member and located to be symmetrical to each other with respect to a center line in a width direction of the insulating member.

5. The differential signal transmission cable according to claim 1, wherein a distance between the two conductor wires and the shield conductor in the alignment direction of the conductor wires is greater than a distance between the two conductor wires and the drain wire.

6. The differential signal transmission cable according to claim 1, wherein the drain wire is provided at each of positions corresponding to the flat portions facing each other.

7. The differential signal transmission cable according to claim 1, wherein a center of the drain wire is located on a center line between both sides of the insulating member in the alignment direction of the conductor wires.

8. The differential signal transmission cable according to claim 1, wherein the drain wire is arranged such that a long side of a rectangular cross section of the drain wire contacts the shield conductor.

9. A differential signal transmission cable comprising:

two conductor wires disposed to be parallel with each other;

a flat insulating member collectively covering the two conductor wires, the insulating member having flat portions facing each other in a direction perpendicular to an alignment direction of the two conductor wires to sandwich the two conductor wires;

a drain wire attached to one of the flat portions of the insulating member;

a shield conductor comprising a metal foil tape, the shield conductor wound around an outer periphery of the insulating member to contact with the drain wire; and a jacket jacketing the shield conductor, wherein a ratio of a distance between the flat portions of the insulating member to a distance between both sides of the insulating member in the alignment direction of the conductor wires is 1:2, and a distance between the two conductor wires is smaller than the distance between the flat portions of the insulating member.

10. The differential signal transmission cable according to claim 9, wherein the drain wire comprises a flexible flat cable comprising a rectangular wire conductor adhered to a film base material.

11. The differential signal transmission cable according to claim 9, wherein the drain wire comprises a flexible printed circuit board comprising a copper foil adhered to a film base material.

12. The differential signal transmission cable according to claim 9, wherein the two conductor wires are located on a center line in a height direction of the insulating member and located to be symmetrical to each other with respect to a center line in a width direction of the insulating member.

13. The differential signal transmission cable according to claim 9, wherein a distance between the two conductor wires and the shield conductor in the alignment direction of the conductor wires is greater than a distance between the two conductor wires and the drain wire.

14. The differential signal transmission cable according to claim 9, wherein the drain wire is provided at each of the flat portions facing each other.

15. The differential signal transmission cable according to claim 9, wherein a center of the drain wire is located on a center line between both sides of the insulating member in the alignment direction of the conductor wires.

16. The differential signal transmission cable according to claim 9, wherein the drain wire is arranged such that a long side of a rectangular cross section of the drain wire contacts the shield conductor.

* * * * *